US008302497B2

(12) United States Patent
Niimi et al.

(10) Patent No.: US 8,302,497 B2
(45) Date of Patent: Nov. 6, 2012

(54) STARTER HAVING NOISE REDUCTION STRUCTURE

(75) Inventors: Masami Niimi, Handa (JP); Mitsuhiro Murata, Niwa-gun (JP); Kiyokazu Haruno, Anjo (JP)

(73) Assignee: Denso Corporation, Kariya (JP)

( * ) Notice: Subject to any disclaimer, the term of this patent is extended or adjusted under 35 U.S.C. 154(b) by 265 days.

(21) Appl. No.: 12/757,120

(22) Filed: Apr. 9, 2010

(65) Prior Publication Data

US 2010/0257975 A1 Oct. 14, 2010

(30) Foreign Application Priority Data

Apr. 10, 2009 (JP) ..... 2009-096104

(51) Int. Cl.
*F02N 15/02* (2006.01)
*F02N 15/06* (2006.01)
*F02N 15/00* (2006.01)

(52) U.S. Cl. ..... 74/7 C; 74/7 R

(58) Field of Classification Search ..... 74/6, 7 C, 74/7 R

See application file for complete search history.

(56) References Cited

U.S. PATENT DOCUMENTS

| | | | | |
|---|---|---|---|---|
| 6,269,706 | B1 * | 8/2001 | Kuragaki et al. | 74/7 A |
| 7,018,314 | B2 * | 3/2006 | Hasegawa et al. | 475/5 |
| 2002/0195893 | A1 * | 12/2002 | Kobayashi et al. | 310/83 |
| 2006/0144175 | A1 * | 7/2006 | Nawa et al. | 74/7 C |

FOREIGN PATENT DOCUMENTS

JP A-2005-330813 12/2005

* cited by examiner

*Primary Examiner* — Justin Krause
(74) *Attorney, Agent, or Firm* — Oliff & Berridge, PLC

(57) ABSTRACT

The present invention provides a starter, including a motor generating torque; a shaft rotating by the torque; a clutch fitting an outer periphery of the shaft; a pinion gear receiving the torque; a pinion control means configured to allow the pinion gear integrally with the clutch to be pushed out; a motor control means for controlling current supplied to the motor; and an inner tube that is arranged to be extended from the inner and in the direction opposite to the motor, supports the pinion gear so as to inhibit rotation thereof with respect to the periphery of the inner tube, and supports the pinion gear to be slidable; wherein a gear-side face and a tube-side face are formed in the pinion gear and the inner tube, respectively, in which the faces are facing each other, and a cushioning member is disposed between the gear-side face and the tube-side face.

8 Claims, 8 Drawing Sheets

SOUND PRESSURE
dB
A

ENGINE SPEED
rpm
ENGINE START
ENGINE STOP SIGNAL
IDLING
PINION PRESET
MESHED

STARTER CURRENT
A
PINION HOLDNIG
CURRENT
TIME

STARTER HAVING NOISE REDUCTION STRUCTURE

CROSS REFERENCE TO RELATED APPLICATION

This application is based on and claims the benefit of priority from earlier Japanese Patent Application No. 2009-96104 filed Apr. 10, 2009, the description of which is incorporated herein by reference.

BACKGROUND OF THE INVENTION 1. (Technical Field of the Invention)

The present invention relates to a starter for starting an engine and, more particularly, the present invention relates to a starter having a structure that reduces operation noise thereof.

2. (Related Art)

Conventionally, automatic engine stop/restart systems (hereinafter referred to as "idle stop system(s)") are known. Such an idle stop system is able to automatically control stop/restart of an engine.

Specifically, Japanese patent Laid-open Publication No. 2005-330813 discloses an idle stop system. The idle stop system includes a pinion control means for controlling the pinion gear to be pushed out towards a ring gear and a motor control means for controlling current to be supplied to the motor on/off. In the idle stop system, the pinion control means and the motor control means are configured such that the both means can be operated individually. With this configuration, even if an event requiring an engine-restart occurs during the engine rotation is decreasing until the engine completely stopped, the pinion gear is pushed out to the ring gear while being rotated whereby the pinion gear meshes with the ring gear. As a result, the engine-restart can be made by powering the motor after completion of the meshing, With this method applied to this configuration, compared to the engine-restart being made after the complete engine stop, the driver of the vehicle does not feel anything uncomfortable because of the smooth engine-restart.

According to the above-described prior art, even if the engine-restart request is not issued while the engine rotation is decreasing, the pinion gear can be meshed with the ring gear when the rotation speed of the ring gear reaches a predetermined value. Subsequently, the meshing between pinion gear and the ring gear can be maintained until the complete engine stop without powering the motor. Therefore, since the pinion gear and the ring gear remain meshed when next engine-restart request occurs, necessary period for the engine-restart can be reduced.

An increase in vehicles including an idle-stop system that automatically controls stop and restart of the engine is expected in the next few years. As the vehicles including the idle stop system increase, for instance, it is expected situations that vehicles become stuck in a local road due to a traffic jam. In this case, it is considered that the engines in the vehicles start at almost the same time. As a result, operation noise of the starter when the engine starts increases and such a noise may cause a noise pollution problem along the road side.

The dominant noise elements accounting for the operation noise of the starter includes a strike noise that occurs when the end face of the pinion gear strikes the end face of the ring gear, a strike noise caused by the teeth faces of the pinion gear and the ring gear when the pinion gear meshes with the ring gear, and an operation noise of the electromagnetic solenoid which is a part of the pinion control means (i.e., a strike noise that occurs when a plunger strikes a core).

However, as described above, when the pinion gear meshes with the ring gear while the engine rotation is decreasing without supplying power to the motor, the end face of the pinion gear strikes the end face of the ring gear and at almost the same time, the plunger of the electromagnetic solenoid strikes the core. As a result, two types of noises caused by both striking influence each other and generate an impact noise that accumulates the noises. Moreover, at the moment, since the motor is not powered so that no operation sound is generated by the motor. Hence, the above-described impact noise significantly stands out and makes the driver of the vehicle uncomfortable.

SUMMARY OF THE INVENTION

The present invention has been made in consideration of the foregoing conventional situation, and an object of the present invention is to provide a starter in which an impact shock caused by striking between the pinion gear and the ring gear is reduced whereby noise caused by the impact shock when the engine starts can be reduced.

In order to achieve the object, the present invention provides, as one aspect, a starter mounted on a vehicle for starting the engine, including: a motor that generates torque by being energized; an output shaft that rotates by receiving the torque from the motor; a clutch that fits an outer periphery of the output shaft; a pinion gear that receives the torque generated by the motor via the clutch; a pinion control means configured to allow the pinion gear integrally with the clutch to be pushed out in the axial direction; a motor control means for controlling current supplied to the motor on and off; and an inner tube that is arranged to be cylindrically extended from the inner and in the direction opposite to the motor, supports the pinion gear so as to inhibit rotation thereof with respect to the periphery of the inner tube, and supports the pinion gear to be slidable in the axial direction; wherein a gear-side pressure receiving face and a tube-side pressure receiving face are formed in the pinion gear and the inner tube, respectively, in which the both faces are facing each other with a predetermined distance in the axial direction, and a cushioning member is disposed between the gear-side pressure receiving face and the tube-side pressure receiving face.

DETAILED DESCRIPTION OF THE PREFERRED EMBODIMENTS

Hereinafter, embodiments of the present invention will now be described in connection with the accompanying drawings.

(First Embodiment)

A starter 1 according to a first embodiment is applied to an idle stop system which automatically controls stop/restart of an engine.

Figure 1:
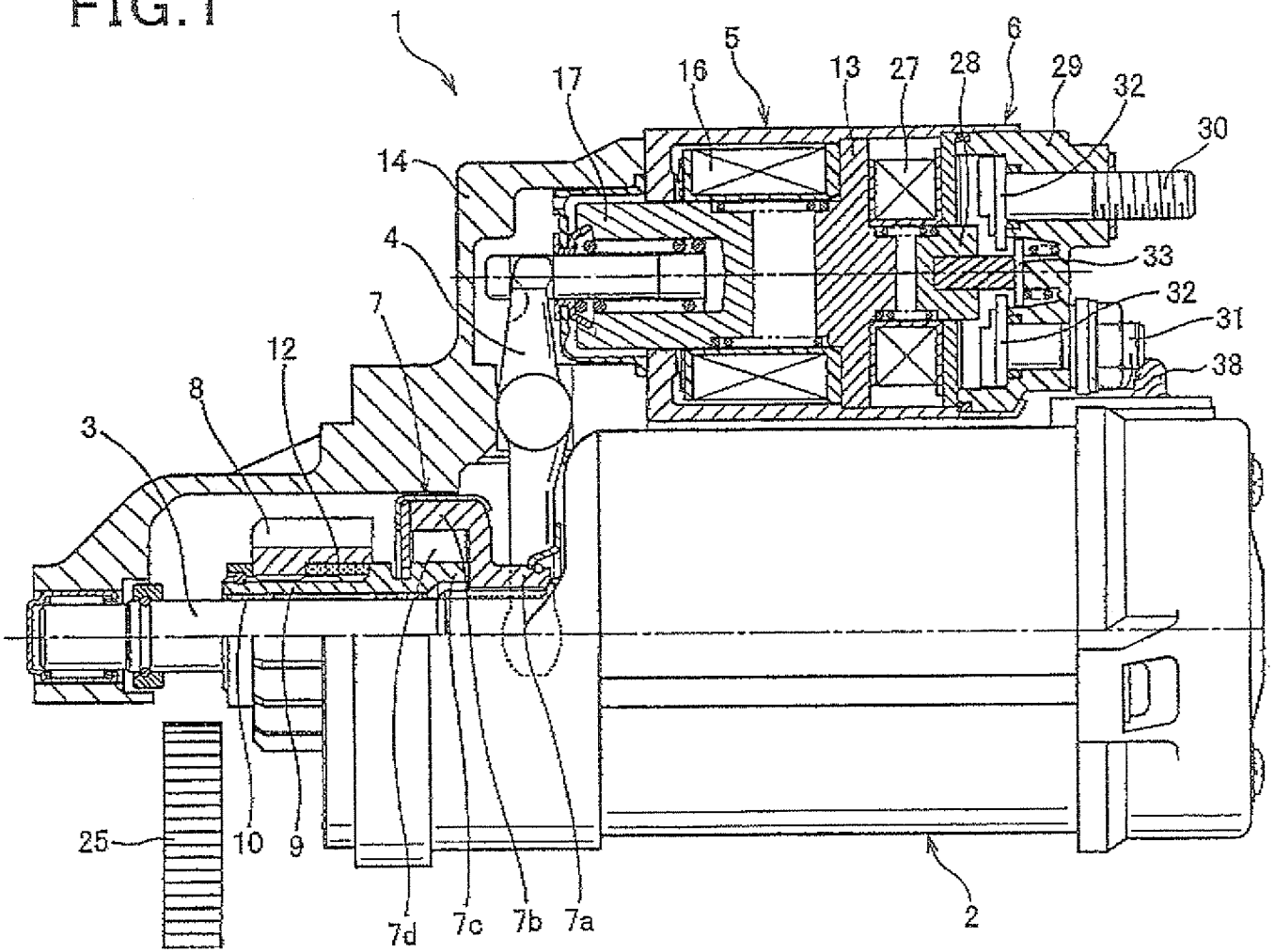
FIG. 1 is a general view of a starter according to a first embodiment of the present invention.

As shown in FIG. 1, the starter 1 includes a motor 2, an output shaft 3, a pinion movable body (described later). The motor 2 generates torque. The output shaft 3 is rotated by the motor 2. The pinion movable body is provided so as to be movable on the periphery of the output shaft 3 and in the axial direction thereof. The starter 1 further includes a solenoid 5 (hereinafter referred to as "pinion solenoid 5") which pushes out the pinion movable body in the direction opposite to the motor (leftward in FIG. 1) via a shift lever 4, a solenoid 6 (hereinafter referred to as "motor solenoid 6") which opens/closes a motor contact (described later), and the like. A reduction gear (e.g. planetary gear reducer) may be provided between an armature 2*a* of the motor 2 (see FIG. 4) and the output shaft 3 so that the torque of the armature 2*a* is reduced and transmitted to the output shaft 3.

The pinion movable body is configured with a clutch 7 and a pinion gear 8 as described below.

The clutch 7 includes a spline barrel 7*a*, an outer 7*b*, an inner 7*c*, a roller 7*d*, and the like. The spline barrel 7*a* fits the periphery of the output shaft 3 (helical spline fitting). The outer 7*b* is provided integrally with the spline barrel 7*a*. The inner 7*c* is arranged at the inner side of the outer 7*b* so as to be rotatable with respect to the outer 7*b*. The roller 7*d* interrupts the transmission of the torque between the outer 7*b* and the inner 7*c*. That is, the pinion movable body acts as a known one-direction clutch, which transmits torque in only one direction from the outer 7*b* to the inner 7*c*.

The clutch 7 has an inner tube 9 provided integrally with the inner 7*c*. The inner tube 9 fits the periphery of the output shaft 3 via bearings 10 so as to be rotatable with respect to the output shaft 3.

Figure 2:
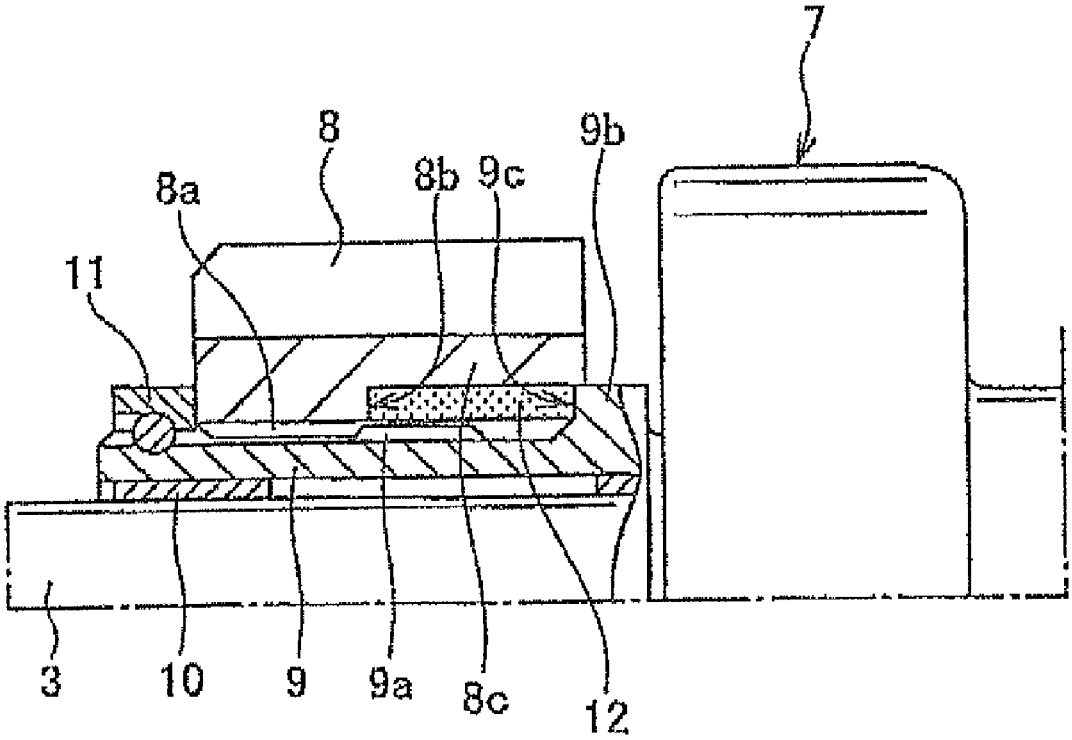
FIG. 2 is a sectional view of a pinion movable body according to the first embodiment.

As shown in FIG. 2, the inner tube 9 cylindrically extends from the inner 7*c* and in the direction opposite to the motor (leftward in FIG. 2). A straight spline 9*a* is formed on the periphery of the inner tube 9 and in the axial direction thereof. A flange 9*b* is provided at the inner side end portion of the inner tube 9. The outer diameter of the flange 9*b* is larger than that of the straight spline 9*a*. The end face of the flange 9*b*, which is located at a position opposite to the inner in the axial direction of the flange 9*b* (left side in FIG. 2), serves as a tube-side pressure receiving face 9*c*.

A pinion gear 8 has a hale which fits the periphery of the inner tube 9 (hereinafter, referred to as "fitting hole"). A straight spline 8*a* (see FIG. 2) is formed on the inner periphery of the fitting hole. The straight spline 8*a* engages with the straight spline 9*a* of the inner tube 9 and rotates integrally with the inner tube 9. The straight spline 8*a* is movable on the periphery of the inner tube 9 and in the axial direction thereof. As shown in FIG. 2, the movement of the pinion gear 8 in the direction opposite to the clutch is restricted by a pinion stopper 11 disposed at an end portion of the inner tube 9 positioned opposite to the inner side.

A large-diameter hole is formed at the inner side of the pinion gear 8. The inner diameter of the large-diameter hole is larger than that of the fitting hole in which the straight spline 8*a* is formed. As shown in FIG. 2, the large-diameter hole is formed at the clutch side with respect to the fitting hole (right side in FIG. 2) in the axial direction of the pinion gear 8. A step is provided between the fitting hole and the large-diameter hole. The step serves as a gear-side pressure receiving face 8*b* which faces the tube-side pressure receiving face 9*c* with a predetermined distance in the axial direction of the inner tube 9. The inner diameter of the large-diameter hale is determined so that the pinion gear 8 can slide on the periphery of the flange 9*b* of the inner tube 9. The length of the pinion gear 8 in the axial direction thereof is slightly longer than the distance between the pinion-side end face of the pinion stopper 11 and the tube-side pressure receiving face 9*c* in the axial direction. That is, as shown in FIG. 2, the pinion gear 8 is located so that the rear end thereof is positioned so as to be slightly distanced from the tube-side pressure receiving face 9*c* to the clutch side in the axial direction when the front end thereof contacts the pinion-side end face of the pinion stopper 11.

A cushioning member 12 is arranged on the inner side of the large-diameter hole formed in the pinion gear 8. The cushioning member 12 is an elastic member made of rubber or elastomer which is a composite of rubber and resin. The cushioning member 12 is held between the tube-side pressure receiving face 9*c* and the gear-side pressure receiving face 8*b* in a state where an initial load is applied therebetween, that is, elastic force is accumulated therebetween. Due to the initial load applied to the cushioning member 12, the pinion gear 8 is pressed against the pinion stopper 11. The initial load applied to the cushioning member 12 preferably has the magnitude which can prevent the pinion gear 8 from moving in the direction opposite to the pinion stopper due to vibration acceleration effected to the starter 1 from the outside thereof.

Hereinafter, configurations of the pinion solenoid S and the motor solenoid 6 are described. The pinion solenoid 5 and the motor solenoid 6 share a fixed core 13. The pinion solenoid 5 and the motor solenoid 6 are integral with each other in the axial direction so as to hold the fixed core 13. As shown in FIG. 1, the pinion solenoid 5 and the motor solenoid 6 are fixed to a starter housing 14 so as to be parallel to the motor 2.

Figure 3:
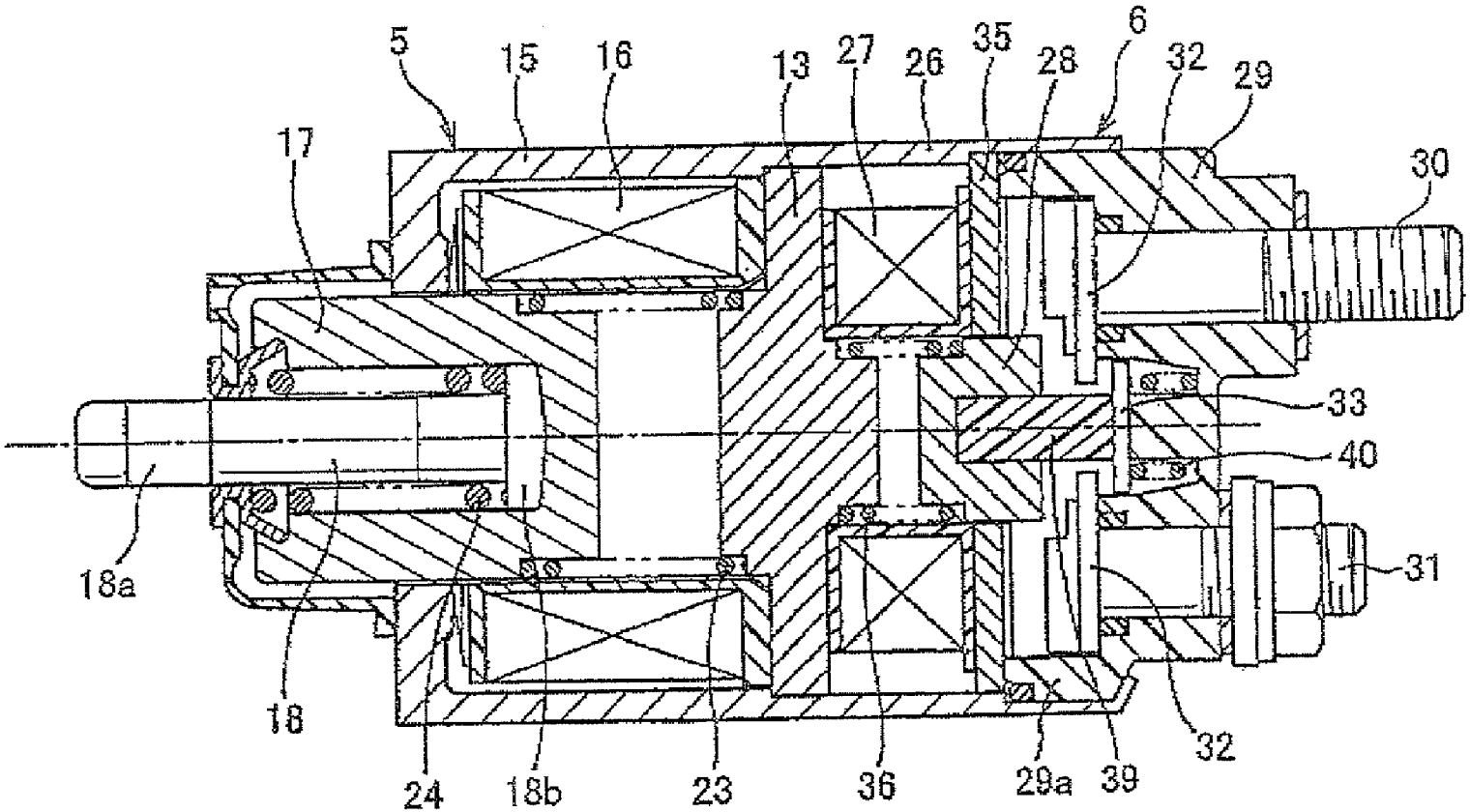
FIG. 3 is a sectional view of a solenoid for pushing out a pinion and a solenoid for supplying current to a motor.

As shown in FIG. 3, the pinion solenoid 5 includes a solenoid case 15, an excitation coil 16, a plunger 17, and a joint 18, in addition to the fixed core 13. The excitation coil 16 is accommodated in the solenoid case 15. The plunger 17 is movable in the axial direction in a state where the plunger 17 faces the fixed core 13. The joint 18 transmits the movement of the plunger 17 to the shift lever 4.

Figure 4:
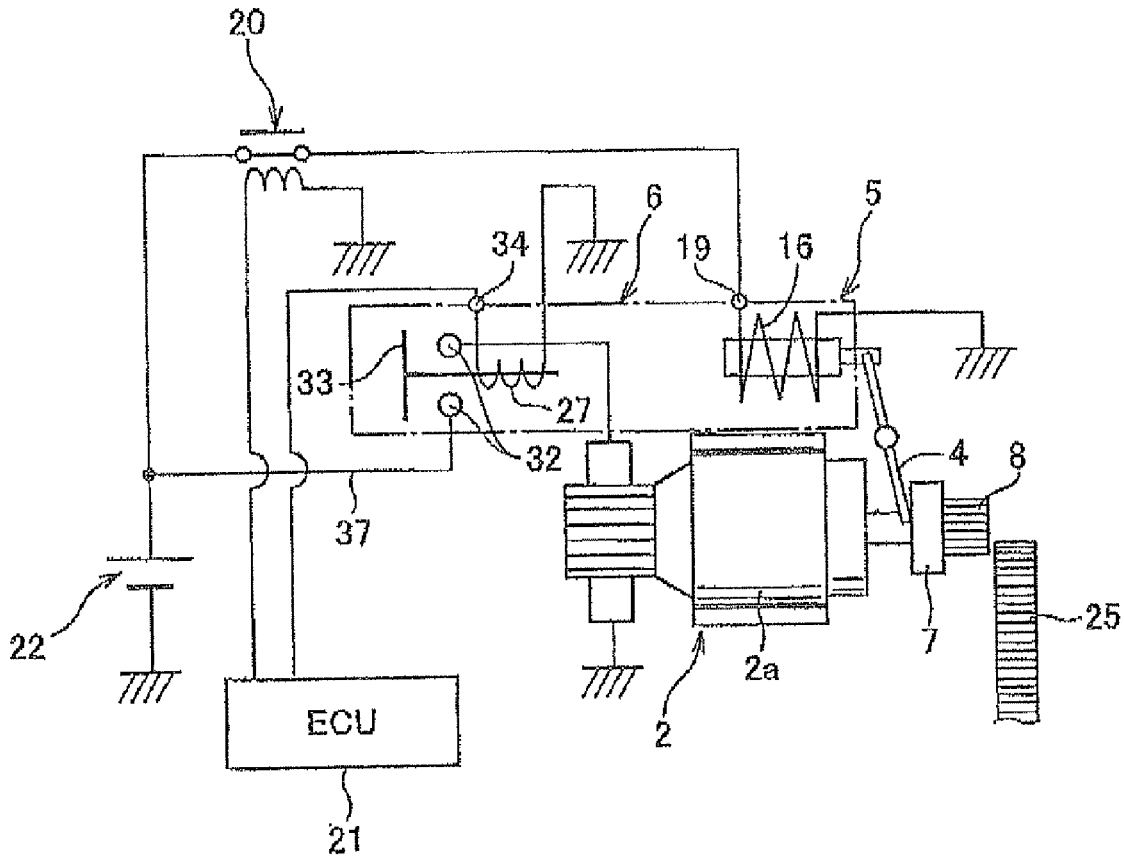
FIG. 4 is an electric circuit diagram of the starter.

As shown in FIG. 4, the excitation coil 16 has one end portion which is connected to a connector terminal 19 and the other end portion which is connected to the surface of the fixed core 13, for example, for grounding by welding or the like. The connector terminal 19 is connected with an electrical wiring which is connected to a starter relay 20.

The starter relay 20 is subjected to on/off control of an electronic control unit 21 (hereinafter referred to as "ECU 21") which controls the operation of the starter 1. When the starter relay 20 is controlled and turned on by the ECU 21, current is supplied to the excitation coil 16 from a battery 22 via the starter relay 20.

When the fixed core 13 is magnetized upon supply of current to the excitation coil 16, the plunger 17 is attracted to the fixed core 13 against the reaction force of a return spring 23 arranged between the plunger 17 and the fixed core 13. The plunger 17 has a substantially cylindrical shape with a cylindrical bore axially formed in the radial center thereof. The cylindrical bore is formed in the plunger 17 so that the plunger 17 is opened at one axial end side (leftward end side in FIG. 3) thereof and bottomed at the other axial end side.

The rod-shaped joint 18 is inserted into the cylindrical bore of the plunger 17 together with a drive spring 24. The joint 18 has one end in which an engagement groove 18*a* is formed which engages with one end of the shift lever 4, and the other end at which a flange 18*b* is formed. The one end of the joint 18 projects from the cylindrical bore of the plunger 17. The flange 18*b* has an outer diameter corresponding to the inner diameter of the cylindrical bore so that the flange 18*b* can slidably move along the inner periphery of the cylindrical bore. Being loaded by the drive spring 24, the flange 18*b* is pressed against the bottom face of the cylindrical bore. With the movement of the plunger 17, the pinion gear 8 is pushed out in a direction opposite to the motor via the shift lever 4. As a result, an end face of the pinion gear 8 comes into contact with an end face of a ring gear 25. During the movement of the plunger 17 from this instance up until the plunger 17 is attracted to the fixed core 13, the drive spring 24 is compressed arid stores reaction force for allowing the pinion gear 8 to engage with the ring gear 25 of the engine.

As shown in FIG. 3, the motor solenoid 6 includes a cylindrical yoke 26, a excitation coil 27, a plunger 28, a contact cover 29, two terminal bolts 30, 31, a pair of fixed contacts 32, and a movable contact 33, in addition to the fixed core 13. The yoke 26 is integrally with the solenoid case 15 by extending the portion of the yoke 26 positioned at the opening side of the solenoid case 15 in the axial direction. The excitation coil 27 is arranged inside the yoke 26. The plunger 28 is movable in the axial direction in a state where the plunger 28 faces the fixed core 13. The contact cover 29 is made of resin and attached to yoke 26 so that the contact cover 29 closes the opening of the yoke 26. The two terminal bolts 30 and 31 are fixed to the contact cover 29. The pair of fixed contacts 32 is connected to a motor circuit via the respective two terminal bolts 30 and 31. The movable contact 33 establishes electrical connection between the pair of fixed contacts 32.

As shown in FIG. 4, the excitation coil 27 has one end which is connected to an external terminal 34 and the other end which is connected to the surface of the fixed core 13, for example, by welding or the like for grounding. The external terminal 34 projects outward from the end face of the contact cover 29 while being connected with an electrical wiring which is connected to the ECU 21.

A magnetic plate 35 is arranged at a position opposite to the fixed core side of the excitation coil 27. The magnetic plate 35 has an annular shape and forms a part of a magnetic circuit. The outer peripheral end face of the magnetic plate 35 positioned at the coil side (left side in FIG. 3) comes into contact with a step provided at the inner periphery of the yoke 26, thereby restricting the position of the magnetic plate 35 at the coil side.

When the fixed core 13 is magnetized upon supply of current to the excitation coil 27, the plunger 28 is attracted to the fixed core 13 against the reaction force of a return spring 36 arranged between the plunger 28 and the fixed core 13.

The contact cover 29 has a cylindrical leg portion 29*a*. The contact cover 29 is arranged in a state where the leg portion 29*a* is inserted into the yoke 26 so that an end face of the leg portion 29*a* is brought into contact with the surface of the magnetic plate 35, Thus, the contact cover 29 is caulked and fixed to the yoke 26. Of the two terminal bolts 30 and 31, the terminal bolt 30 is a B terminal bolt to which a battery cable 37 (see FIG. 4) is connected, and the terminal bolt 31 is an M terminal bolt to which a motor lead wire 38 (see Fig, 1) is connected.

The pair of fixed contacts 32 is provided separately from the two terminal bolts 30 and 31, for example, and is fixed to the two terminal bolts 30 and 31 inside the contact cover 29.

The movable contact 33 is provided on the side opposite to the plunger 28 (right side in FIG. 3) and is located at a position more distanced from the plunger 28 than at the position where the pair of fixed contacts 32 is located. The movable contact 33 is pressed against an end face of a resinous rod 39 fixed to the plunger 28 while being loaded by a contact pressure spring 40. In this regard, the initial load of the return spring 36 is set to a value larger than that of the initial load of the contact pressure spring 40. Therefore, when current is not supplied to the excitation coil 27, the movable contact 33 is allowed to sit on an inner seat surface of the contact cover 29 in a state of pressing and contracting the contact pressure spring 40.

The motor contact mentioned hereinbefore is formed of the pair of fixed contacts 32 and the movable contact 33. When the movable contact 33 comes into contact with the pair of fixed contacts 32 and is biased by the contact pressure spring 40, current is applied across the fixed contacts 32, whereby the motor contact is closed. On the other hand, when the movable contact 33 comes out of contact with the pair of fixed contacts 32, the current application across the contacts 32 is shut off, whereby the motor contact is opened.

Next, an operation of the starter 1 is described.

a) In a case where the engine is started in a normal manner (that is, a case where the engine is started by the user's turn-on operation of an ignition switch (not shown) in a state where the engine is completely stopped):

The ECU 21 effects control to close the starter relay 20 upon reception of an engine start signal produced by the user's turn-on operation of the ignition switch. Thereby, the excitation coil 16 of the pinion solenoid 5 is supplied with current from the battery 22, whereby the plunger 17 is moved by being attracted to the magnetized fixed core 13. With the movement of the plunger 17, the pinion gear 8 is pushed out integrally with the clutch 7 in the direction opposite to the motor via the shift lever 4 and stops in a state where the end face of the pinion gear 8 is in contact with the end face of the ring gear 25.

After expiration of the predetermined time following the production of the engine start signal, the ECU 21 outputs a turn-on signal to the excitation coil 27 of the motor solenoid 6. Thereby, current is supplied to the excitation coil 27, whereby the plunger 28 is attracted to the fixed core 13. Thereby, the movable contact 33 comes into contact with the pair of fixed contacts 32 and is biased by the contact pressure spring 40, whereby the main contact is closed. As a result, current is supplied to the motor 2 to generate torque of the armature 2*a*. The torque is then transmitted to the output shaft 3. Furthermore, the rotation of the output shaft 3 is transmitted to the pinion gear 8 via the clutch 7. When the pinion gear 8 has rotated up to a position enabling engagement with the ring gear 25, the pinion gear 8 engages with the ring gear 25 by the reaction force stored in the drive spring 24. Thereby, the torque is transmitted from the pinion gear 8 to the ring gear 25 to crank the engine.

Figures 5A, 5B, 5C:
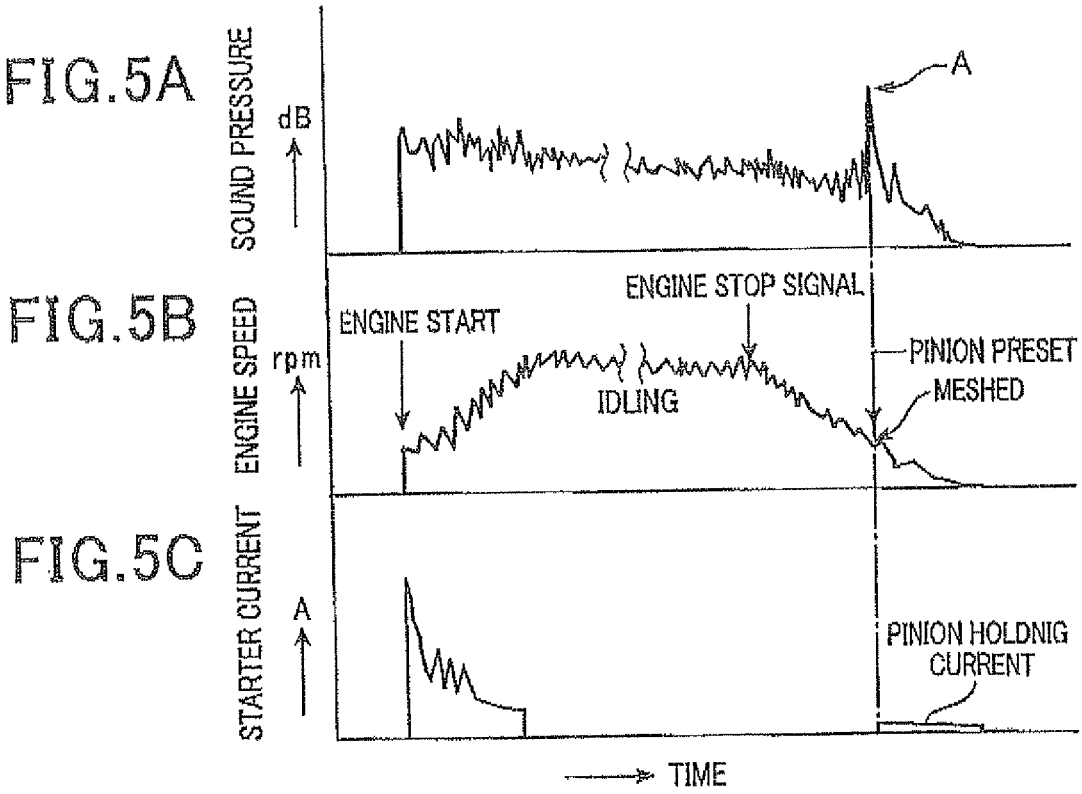
FIG. 5A is a graph of sound pressure which is produced at the time the starter operates.
FIG. 5B is a graph of engine speed.
FIG. 5C is a graph of starter current.

When the engine starts, the ECU 21 outputs a turn-off signal, which stops the supply of current to the excitation coil 16 of the pinion solenoid 5 and the excitation coil 27 of the motor solenoid 6. As a result, the attraction force of the pinion solenoid 5 is lost, whereby the plunger 17 is pushed back. Thereby, the pinion gear 8 is released from the ring gear 25. Then, the pinion gear 8 moves on the periphery of the output shaft 3 to the rest position (shown in FIG. 1) integrally with the clutch 7 and stops. In addition, the attraction force of the motor solenoid 6 is lost, whereby the plunger 28 is pushed back. Thereby, the motor contact is opened to stop the power feed from the battery 22 to the motor 2. Then, the rotation of the armature 2*a* gradually decelerates and stops.

b) In a case where an idle stop is performed when the vehicle is in an idling state or a case where a user operates an ignition switch to the engine stop position:

The ECU 21 outputs an engine stop signal to stop the fuel injection and the supply of intake air to the engine. Thereby, the engine proceeds to a stop process in which, as shown in FIG. 5B, the rotation of the ring gear 25 (shown as engine speed in FIG. 5B) starts to decelerate. When the rotation of the ring gear 25 decelerates up to the predetermined engine speed, the ECU 21 outputs a turn-on signal to the excitation coil 16 of the pinion solenoid 5. As a result, the pinion gear 8 is pushed out integrally with the clutch 7 in the direction opposite to the motor. Thereby, the end face of the pinion gear 8 comes into contact with the end face of the ring gear 25. Thereafter, when the ring gear 25 rotates up to the position at which the ring gear 25 can engage with the pinion gear 8, the engagement between the pinion gear 8 and the ring gear 25 is established.

Thereafter, the ring gear 25 continues to rotate with deceleration and stops. The pinion gear 8 rotates together with the ring gear 25 while engaging with the ring gear 25, and stops. In the meantime, as shown in FIG. 5C, the excitation coil 16 of the pinion solenoid 5 is supplied with holding current by which the engagement between the pinion gear 8 and the ring gear 25 can be maintained. Hereinafter, the following operation is referred to as "pinion preset", which is performed in the stop process of the engine. In this operation, the pinion solenoid 5 is actuated during rotation of the ring gear 25 to make the pinion gear 8 engage with the ring gear 25. While the pinion preset is performed, current is not supplied to the excitation coil 27 of the motor solenoid 6.

c) When the engine is restarted after the pinion preset:

Next, when the ECU 21 outputs a restart signal for the engine, current is supplied to the excitation coil 27 of the motor solenoid 6, whereby the motor contact is dosed. As a result, current is supplied to the motor 2 to generate torque of the armature 2*a*. At this time, since the pinion gear 8 has already engaged with the ring gear 25, the torque of the motor 2. is transmitted from the pinion gear 8 to the ring gear 25 to crank the engine.

(Advantages of the First Embodiment)

In the starter 1 of the present embodiment, the pinion solenoid 5 and the motor solenoid 6 are separately controlled by the ECU 21. Hence, in a case where the engine is stopped when the vehicle is in an idling state, even after only the pinion solenoid 5 is actuated to engage the pinion gear 8 with the rotating ring gear 25 and then the rotating ring gear 25 stops, the engagement between the pinion gear 8 and the ring gear 25 can be maintained. Thereafter, when the engine is restarted, the pinion gear 8 has already engaged with the ring gear 25. Therefore, only actuating the motor solenoid 6 is required, which closes the motor contact. That is, when the engine is restarted, the pinion movable body is not required to be pushed out, which shorten the time to make the pinion gear 8 engage with the ring gear 25. Therefore, the engine can restart quickly.

While the pinion preset is performed, at the substantially same time when the end face of the pinion gear 8 strikes the end face of the rotating ring gear 25, the plunger 17 of the pinion solenoid 5 strikes the fixed core 13. Hence, impact noises due to the two impacts are produced and combined with each other. When sound pressure is measured which is produced at the time the starter 1 operates, as shown in FIG. 5A, the sound pressure level of the impact noises is larger than that of the operation noise of the starter 1 produced at the time the engine normally starts. In addition, when the pinion preset is performed, current is not supplied to the motor 2. Therefore, noises due to the operation of the motor 2 are not produced, which emphasizes only the above impact noises remarkably. FIG. 5A shows a waveform of sound pressure produced at the time the starter 1 operates. FIG. 5B shows a waveform of engine speed. FIG. 5C shows a waveform of starter current. The arrow "A" in FIG. 5A indicates the sound pressure produced at the time the pinion preset is performed (the time the pinion gear 8 is engaged with the ring gear 25 by actuating the pinion solenoid 5 while the rotation of the ring gear 25 decelerates).

To solve the above problems, in the starter 1 according to the embodiment, the cushioning member 12 is incorporated into the pinion movable body. Specifically, the cushioning member 12, which is an elastic member made of rubber, elastomer, or the like, is arranged between the tube-side pressure receiving face 9*c* formed by the flange 9*b* of the inner tube 9 and the step provided between the fitting hole and the large-diameter hole of the pinion gear 8. Hence, when the end face of the pinion gear 8 strikes the end face of the ring gear 25, the member 12 is contracted between the tube-side pressure receiving face 9*c* and the gear-side pressure receiving face 8*b*, which reduces the impact between the end face of the pinion gear 8 and the end face of the ring gear 25. Therefore, the noise of the starter 1 can be reduced which is produced due to the impact propagated to the output shaft 3 and the like.

Figure 6:
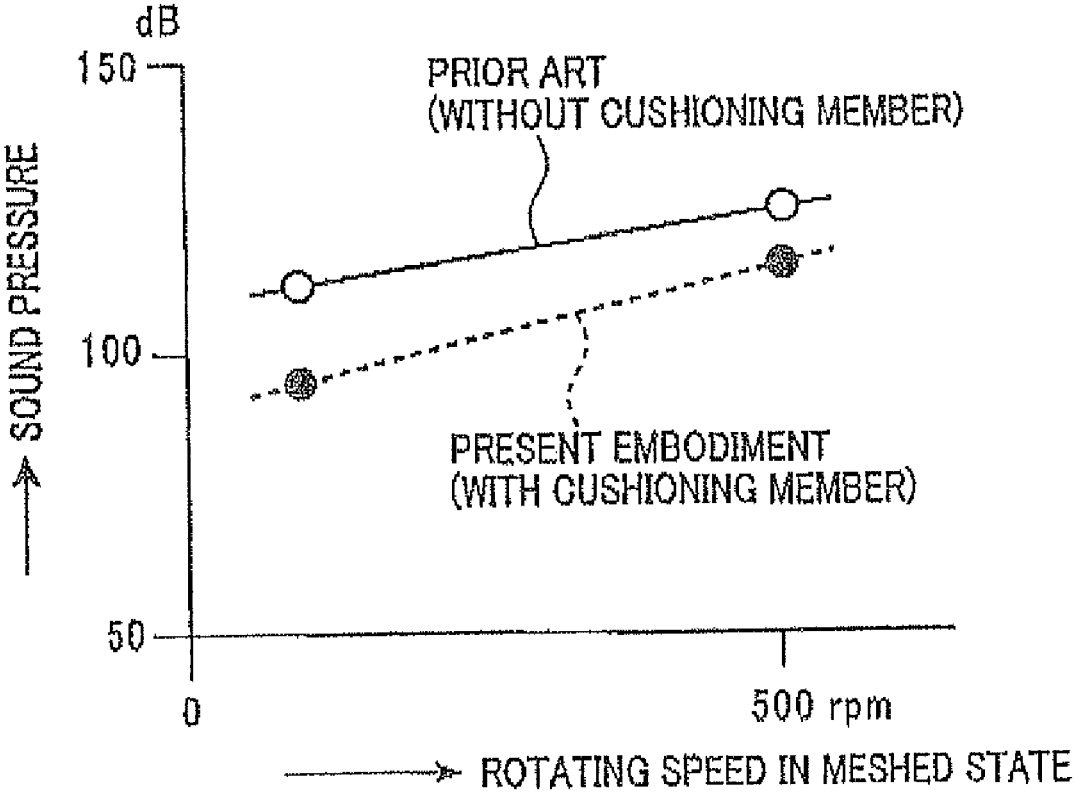
FIG. 6 shows results of the measurement of sound pressure obtained while pinion preset is performed.

FIG. 6 shows results of the measurement of sound pressure at point "A" shown in FIG. 5A. The measurement is conducted by using the starter 1 in which the cushioning member 12 is incorporated into the pinion movable body, and the conventional starter which does not have the cushioning member 12. In FIG. 6, the axis of abscissa indicates rotating speed in meshed state between the pinion gear 8 and the ring gear 25, and the axis of ordinate indicates sound pressure. As shown in FIG. 6, the starter 1 according to the embodiment can reduce the sound pressure while the pinion preset is performed, compared with the conventional starter.

As described above, the starter 1 according to the embodiment can reduce the noise (the noise of the starter 1) produced when the engine is restarted after an idle stop. Hence, an idle stop system can be provided which is comfortable for a user, without harming the environment along roads.

In addition, in the pinion movable body according to the embodiment, the cushioning member 12 is disposed at the inner periphery of the large-diameter hole formed in the pinion gear 8. Hence, an expansion preventing means can be provided at the outer periphery side of the cushioning member 12. That is, as shown in FIG. 2, a boss 8*c* of the pinion gear 8, which forms the large-diameter hole, is provided at the outer periphery side of the cushioning member 12. Hence, the boss 8*c* can functions as the expansion preventing means, which prevents the cushioning member 12 from radially expanding to the outside by centrifugal force when the pinion movable body rotates. Thereby, the pinion movable body is pushed out to the ring gear 25 of the engine. Even when the end face of the pinion gear 8 strikes the end face of the ring gear 25, the function of the cushioning member 12 is not degraded which reduces the impact between the end face of the pinion gear 8 and the end face of the ring gear 25, thereby exerting the predetermined effects of the cushioning member 12.

In addition, in the pinion movable body according to the embodiment, the maximum diameters of the gear-side pressure receiving face 8*b* and the tube-side pressure receiving face 9*c* are smaller than the root diameter of the pinion gear 8, and the minimum diameters of the gear-side pressure receiving face 8*b* and the tube-side pressure receiving face 9*c* are larger than the outer diameter of the inner tube 9. According to the configuration, a space for the cushioning member 12 can be provided between the root diameter of the pinion gear 8 and the outer diameter of the inner tube 9. Furthermore, the cushioning member 12 can be disposed within the axial dimension of the pinion gear 8. Hence, the pinion movable body is prevented from increasing in size, while the cushioning member 12 can be incorporated into the pinion movable body.

(Second Embodiment)

Figure 7:
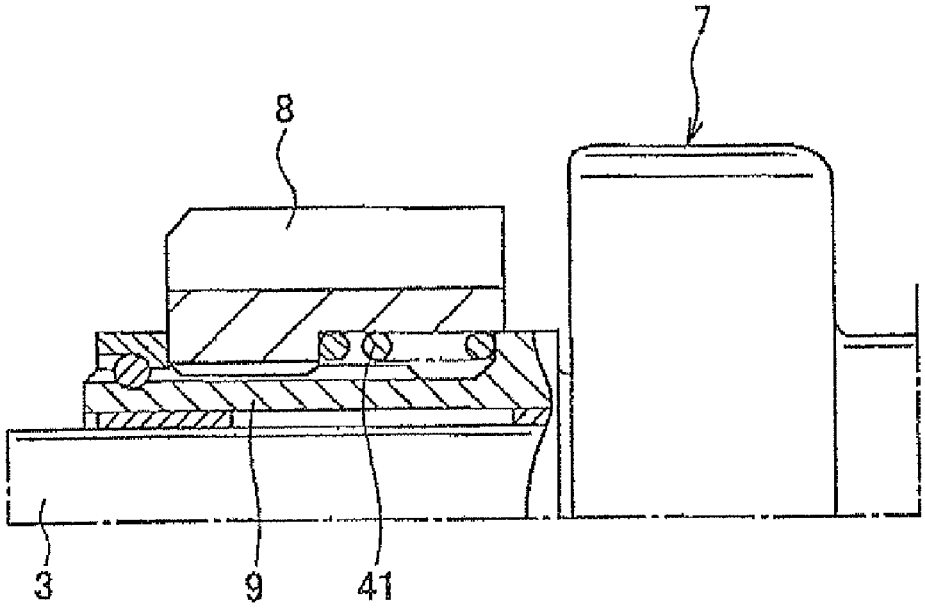
FIG. 7 is a sectional view of a pinion movable body according to a second embodiment.

According to a second embodiment, as shown in FIG. 7, a helical compression spring 41 is employed as the cushioning member 12. According to the configuration, since a general-purpose helical compression spring can be used as the helical compression spring 41, manufacturing costs of the starter can be reduced.

(Third Embodiment)

Figure 8:
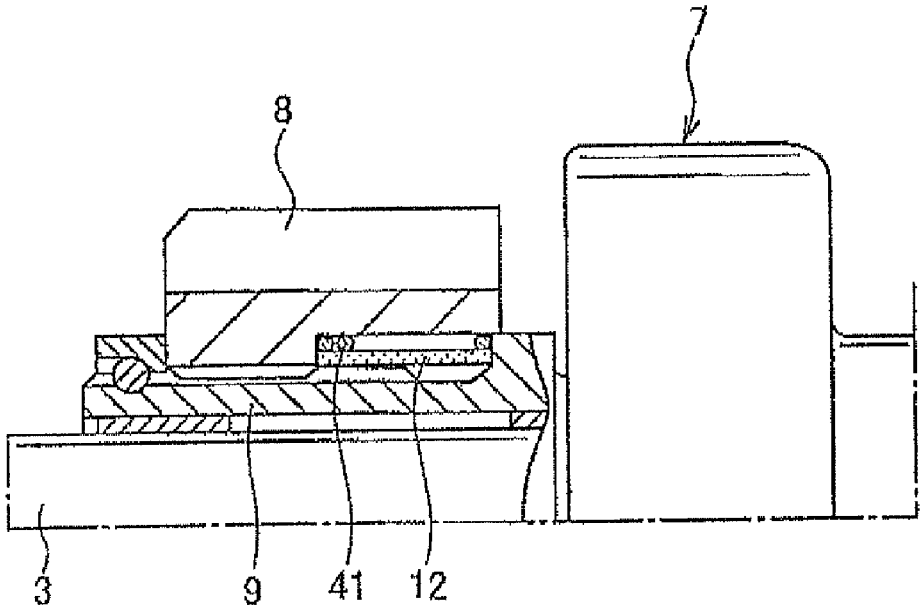
FIG. 8 is a sectional view of a pinion movable body according to a third embodiment.

According to a third embodiment, as shown in FIG. 8, the in combination of an elastic body such as rubber or elastomer and the helical compression spring 41 is used as the cushioning member 12.

According to the configuration, the impact is absorbed by the helical compression spring 41 and is reduced by the elastic body, whereby the noise of the starter can be further reduced.

(Fourth Embodiment)

According to a fourth embodiment, axial length of the teeth of the pinion gear 8 is shortened with respect to that of the boss 8*c*.

Figure 9:
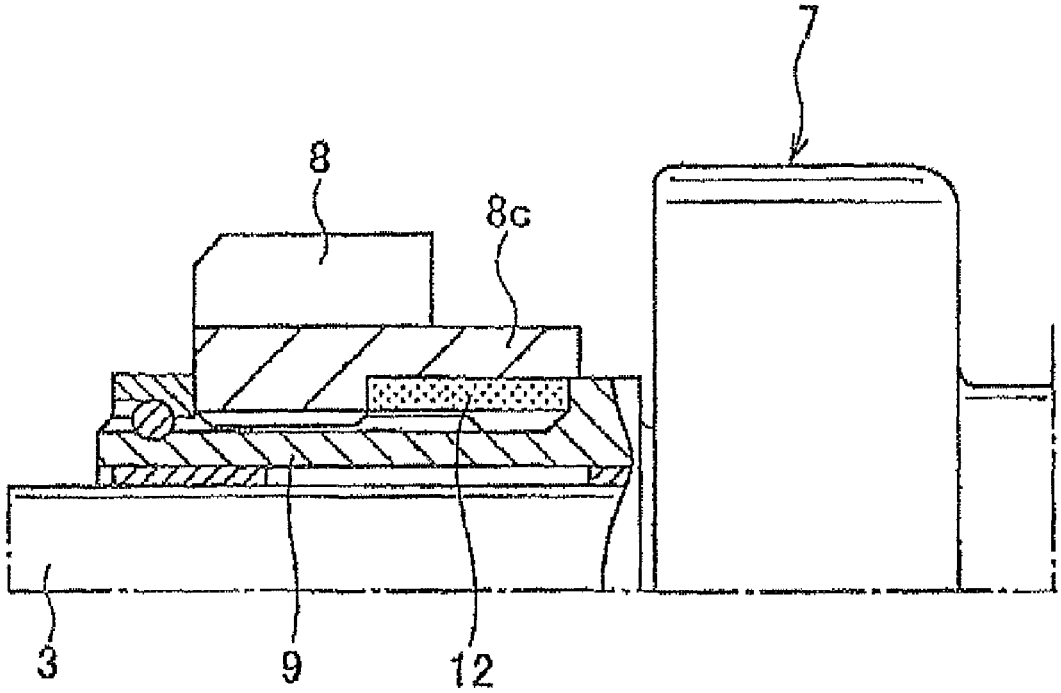
FIG. 9 is a sectional view of a pinion movable body according to a fourth embodiment.

The axial length of the teeth of the pinion gear 8 is simply required so that the teeth of the pinion gear S can engage with the ring gear 25. Hence, as shown in FIG. 9, the axial length of the teeth can be shortened with respect to that of the boss Sc. Meanwhile, lengthening the axial length of the boss 8*c* compared with that of the teeth can provide the expansion preventing means for the cushioning member 12 at the periphery of the large-diameter hole.

It will be appreciated that the present invention is not limited to the configurations described above, but any and all modifications, variations or equivalents, which may occur to those who are skilled in the art, should be considered to fall within the scope of the present invention.

What is claimed is:

1. A starter mounted on a vehicle for starting the engine, comprising:

a motor that generates torque by being energized;

an output shaft that rotates by receiving the torque from the motor;

a clutch that fits an outer periphery of the output shaft;

a pinion gear that receives the torque generated by the motor via the clutch;

a pinion control means configured to allow the pinion gear to be pushed out in the axial direction integrally with the clutch;

a motor control means for controlling current supplied to the motor on and off;

a control means for separately controlling the pinion control means and the motor control means; and an inner tube that is arranged to be cylindrically extended from an inner portion of the clutch and in the direction opposite to the motor, supports the pinion gear so as to inhibit rotation thereof with respect to the periphery of the inner tube, and supports the pinion gear to be slidable in the axial direction;

wherein a gear-side pressure receiving face and a tube-side pressure receiving face are formed in the pinion gear and the inner tube, respectively, in which the both faces are facing each other with a predetermined distance in the axial direction, and a cushioning member is disposed between the gear-side pressure receiving face and the tube-side pressure receiving face.

2. The starter according to claim 1, wherein the cushioning member is an elastic member made of rubber or elastomer which is a composite of rubber and resin.

3. The starter according to claim 1, wherein the cushioning member is a helical compression spring.

4. The starter according to claim 1, wherein the cushioning member is an elastic member that combines a helical compression spring and a rubber.

5. The starter according to claim 1, wherein the cushioning member is elastic member that combines a helical compression spring and elastomer which is a composite of rubber and resin.

6. The starter according to claim 1, wherein a pinion stopper is disposed at an end portion of the inner tube positioned opposite to the tube in order to restrict the movement of the pinion gear in the direction opposite to the clutch, an initial load is applied to the cushioning member to prevent the pinion gear from moving in the direction opposite to the pinion stopper due to vibration acceleration effected to the starter from the outside thereof.

7. The starter according to claim 1, wherein an expansion preventing means is provided at the outer periphery side of the cushioning member to prevent the cushioning member from radially expanding to the outside by rotational force of the pinion gear.

8. The starter according to claim 1, wherein the maximum diameters of the gear-side pressure receiving face and the tube-side pressure receiving face are smaller than the root diameter of the pinion gear, and the minimum diameters of the gear-side pressure receiving face and the tube-side pressure receiving face are larger than the outer diameter of the inner tube.

* * * * *